US005351426A

United States Patent [19]

Voy et al.

[11] Patent Number: 5,351,426

[45] Date of Patent: Oct. 4, 1994

[54] LABEL ASSEMBLY

[75] Inventors: Peter A. Voy, El Dorado Hills; Robert D. Ihle, Sacramento, both of Calif.

[73] Assignee: CCL Label Inc., Grand Rapids, Mich.

[21] Appl. No.: 993,907

[22] Filed: Dec. 18, 1992

Related U.S. Application Data

[63] Continuation of Ser. No. 573,384, Aug. 24, 1990, abandoned, which is a continuation of Ser. No. 210,765, Jun. 23, 1988, abandoned, which is a continuation of Ser. No. 31,888, Mar. 30, 1987, abandoned, which is a continuation-in-part of Ser. No. 671,294, Nov. 14, 1984, Pat. No. 4,661,189.

[51] Int. Cl.[5] ..... G09F 3/10

[52] U.S. Cl. ..... 40/638; 40/630; 428/42

[58] Field of Search ..... 40/299, 630, 638, 594; 428/40, 42

[56] References Cited

U.S. PATENT DOCUMENTS

| | | | |
|---|---|---|---|
| 984,443 | 2/1911 | Sanderson . | |
| 1,922,767 | 8/1933 | Humphner | 40/299 |
| 2,095,437 | 10/1937 | Fox | 40/299 |
| 2,304,787 | 12/1942 | Avery . | |
| 2,391,539 | 12/1945 | Avery . | |
| 2,439,082 | 4/1948 | Emmey et al. | 40/299 |
| 2,467,572 | 4/1949 | Weisselberg . | |
| 2,783,172 | 2/1957 | Avery . | |
| 2,880,539 | 4/1959 | Frenkel et al. . | |
| 3,411,978 | 11/1968 | Frohbach et al. | 428/42 |
| 3,930,092 | 12/1975 | Shapiro | 428/204 |
| 3,963,124 | 6/1976 | Banks | 40/638 X |
| 4,008,115 | 2/1977 | Fairbanks et al. . | |
| 4,022,926 | 5/1977 | Keough et al. . | |
| 4,028,474 | 6/1977 | Martin | 428/352 X |
| 4,056,661 | 11/1977 | Sato et al. . | |
| 4,068,028 | 1/1978 | Samonides | 428/352 X |
| 4,214,024 | 7/1980 | Jacobson | 40/299 X |
| 4,244,125 | 1/1981 | Corey | 40/638 |
| 4,253,899 | 3/1981 | Takemoto et al. | 156/289 X |
| 4,253,899 | 3/1981 | Takemoto et al. . | |
| 4,260,444 | 4/1981 | Fowler . | |
| 4,281,762 | 8/1981 | Hattemer . | |
| 4,285,754 | 8/1981 | DiMatteo . | |
| 4,359,358 | 12/1982 | Hattemer . | |
| 4,479,838 | 10/1984 | Dunsirn et al. | 40/630 |
| 4,529,229 | 7/1985 | Glibbery . | |
| 4,637,149 | 1/1987 | Rivkin | 40/594 X |

FOREIGN PATENT DOCUMENTS

| | | | |
|---|---|---|---|
| 1372615 | 10/1974 | United Kingdom | 428/42 |

OTHER PUBLICATIONS

Advertisement of Meltex Corporation entitled "Hot Melt-Screen Coater CP 200".

Advertisement of Matrix Industries, Inc. entitled "Cora-Drum".

*Primary Examiner*—Brian K. Green

*Attorney, Agent, or Firm*—Warner, Norcross & Judd

[57] ABSTRACT

A label assembly improving the releasability of individual labels from a carrier sheet. The labels are spaced along the length of the carrier sheet in a longitudinal direction. An adhesive temporarily retains the labels on the carrier sheet. A transverse leading edge of each label is adhesive-free. Benefits include a) reduced adhesion of the labels to the carrier sheet during die-cutting of the labels and b) improved releasability of the labels from the carrier sheet during label application.

4 Claims, 5 Drawing Sheets

LABEL ASSEMBLY

SPECIFICATION

This is a continuation of application Ser. No. 573,384, filed Aug. 24, 1990 (now abandoned), which is a continuation of application Ser. No. 210,765, filed Jun. 23, 1988 (now abandoned), which is a continuation of application Ser. No. 031,888, filed Mar. 30, 1987 (now abandoned), which is a continuation-in-part of application Ser. No. 671,294, filed Nov. 14, 1984 (now U.S. Pat. No. 4,661,189).

BACKGROUND OF THE INVENTION

1. Field of the Invention

The present invention relates to a method and apparatus for manufacturing discrete elements, the discrete elements and to a method and apparatus for applying the discrete elements ads more particularly to such a method and apparatus which and particularly well suited to the manufacturing of substantially planar discrete elements such as labels and still more particularly labels of the pressure sensitive type in a continuous, rapid operation and having application to the manufacture of labels of a wide variety of different types.

2. Description of the Prior Art

There are a variety of industries in which discrete elements must be manufactured at high rates of speed, but where the cost of such manufacture and the limitations inherent in conventional methods and apparatus severely restrict manufacture. For example, the label manufacturing industry produces labels which are typically sold in rolls consisting of a carrier or release sheet on which are adhesively, but releasably, arranged a multiplicity of labels. Typically the purchasers of such rolls are manufacturers and/or packagers of products. By way of illustration, bottlers or products such as milk, employ machines which accept such rolls of labels and which automatically and successively dispense labels from the rolls and individually apply the labels to the bottles or containers of milk in a predetermined orientation and location. The labels are, of course, printed to order for the bottler so as to contain information relating to the particular products to which they are to be applied.

Label manufacturers must have the capability of manufacturing labels of a multitude of different types so as be able to meet the ends of their customers. Thus, label manufacturers may be requested to produce labels of virtually any size and shape, of a variety of different materials, with printing which is exposed or buried beneath a lacquer transparent plastic film as well as to provide labels having multiple surfaces or portions which can be torn off by the end purchaser for use as a coupon or the like. For example, in the bottling industry, where packaging, distribution and display of the bottles causes the bottles to abrade each other, it is desirable to use labels in which the printing is buried beneath and readable through a protective surface so that such printing is not worn off.

A further complication for label manufacturers resides in the fact that adhesive employed to retain the labels on carrier sheet and thereafter for retaining the label on the product are often slow to set or cure. Such curing is commonly too slow to permit the label manufacturers to produce their own laminated, stock, print, die cut, strip the waste matrix from the carrier sheet and wind the carrier sheet bearing the resulting labels into a roll, all in a single continuous process. For purposes of description herein the terms "prelaminated stock" and "laminated stock" are used to mean a carrier or release sheet to which an element sheet has been adhesively attached, but wherein printing, die cutting and other processing of the element sheet has not been carried out. Thus, "prelaminated stock" and "laminated stock" are used herein to mean adhesively interconnected carrier and element sheets disposed in registry with each other to form a lamination, but not otherwise processed to form labels on the carrier sheet. Such prelaminated stock is most commonly wound into a roll for storage, handling and subsequent processing to form labels.

Prior art efforts to form laminated stock, print, die cut and otherwise complete rolls of labels in a single continuous process have resulted in the adhesive migrating, prior to setting of the adhesive, beyond the peripheries of the labels during manufacture and thereafter. In such prior art efforts the problem of adhesive migration has been chronic. Adhesive migration has interfered with die cutting of the labels add stripping of the waste matrix therefrom as well as with winding of the carrier sheet bearing the labels into a roll. Further, once the carrier sheet bearing the labels is wound into a roll, the adhesive may continue to migrate beyond the peripheries of the labels causing surfaces within the roll to stick together and, at very lest, interfering with dispensing of the labels from the carrier sheet. Additionally, it has been found impractical to allow the adhesive to set once the prelaminated stock has been formed and prior to such printing, die cutting, stripping and winding steps since this setting or curing process, depending upon the type of adhesive, often takes seven full days to be completed.

Consequently, conventional practice calls for label manufacturers to buy prelaminated stock, or manufacture it themselves and allow it to cure, in meeting their needs and those of their customers. The prelaminated stock is thereafter printed and die cut to form the labels in accordance with the needs of those customers. This requires label manufacturers to maintain large inventories of prelaminated stock of a wide variety of types so as to be able to fill, on relatively short notice, their customers' orders. Not only are such inventories expensive to, maintain and store, but the prelaminated stock is itself expensive to purchase.

In addition, because of the foregoing conventional practices, it is, as a practical matter, impossible to manufacture labels of certain types since printing must conventionally be performed by the label manufacturer prelamination of the stock is performed by another company prior to receipt by the label manufacturer. For example, it is as a practical matter not possible to produce labels in which the printing is captured on the reverse side of a transparent element sheet and thus between that element sheet and its carrier sheet. This is the case because, of course, the printing must be applied to the underside of the transparent element sheet in order to be visible through the element sheet and yet it is the manufacturer of the prelaminated stock, not the label manufacturer, which must adhesively apply the element sheet to the carrier sheet. Referring again to the example of bottling companies, this makes the production of buried print labels, wherein the printing is buried beneath and readable through a transparent film in order to protect the printing from scuffing by other bottles, impractical or inordinately expensive to produce.

Still further, these same considerations would make it advantageous in many situations to reduce the cost of materials and of applying the labels even further. The liner or carrier sheet, for example, constitutes up to fifty percent of the cost of the product. The carrier sheet can, in addition, increase the overall cost of production in that it can become damaged during die cutting of the labels thereby interfering with removal of the waste matrix and either requiring a substantial reduction in the speed of manufacture or complete shutdown of the manufacturing equipment for repair.

Similarly, conventional practices for applying the labels to the designated products is frequently less than satisfactory in that the labels are typically peeled from the carrier sheet and applied to the products in a less than direct manner resulting in precise registry with the products, jamming of equipment, no labels being applied to some products and, accordingly, substantial downtime.

Therefore, it has long been known that it would be desirable to have a method and apparatus for manufacturing discrete elements, the discrete elements, and a method and apparatus for applying the discrete elements, wherein all steps involved in producing such elements can be performed at one place of operation and in a single continuous process permitting label manufacturers to produce labels of virtually any type rapidly, inexpensively and without requiring the purchase and maintaining of an inventory of prelaminated stock and wherein discrete elements such as labels can be applied to their designated products precisely, dependably and at minimum cost.

SUMMARY OF THE INVENTION

Therefore, it is an object of the present invention to provide an improved method and apparatus for manufacturing discrete elements, the discrete elements and a method and apparatus for applying the discrete elements.

Another object is to provide such a method which obviates the need for label manufacturers to purchase and maintain inventories of prelaminated stock or to manufacture their own prelaminated stock for later use in order to the capability of rapidly filling their customers' orders.

Another object is to provide such a method which permits labels or the like of a wide variety of shapes, sizes, forms of construction and utility to be manufactured while achieving all of the other advantages possessed by the method the present invention.

Another object is to provide such a method which permits the steps of printing, laminating, die cutting, stripping of the waste matrix and winding of labels borne by a carrier sheet into a roll to be performed in a single continuous operation.

Another object is to provide such a method which allows label manufacturers to reduce substantially the cost of manufacturing labels while at the same time increasing the number of types of labels which can be manufactured.

Another object is to provide such a method precludes the multitude of problems encountered in conventional methods by adhesive migration, or, more particularly, the movement of adhesives which retain labels and the like on a carrier sheet beyond predetermined boundaries prior to curing of the adhesives, the method of the present invention thereby avoiding such problems encountered in conventional methods as unwanted adhesion between the fibers of the carrier sheet beyond its silicone coating and the labels, between the die cutting assemblies and the migrated adhesive, between the carrier sheet and the waste matrix between surfaces of the carrier sheet and labels during rewinding, between surfaces of the carrier sheet and labels within the roll after rewinding and between the carrier sheet and labels during dispensing of the labels from the carrier sheet.

Another object is to provide such a method which permits the rapid and inexpensive manufacture of labels in which the print constituting the written subject matter of the label is buried beneath a transparent film through which the print can be read.

Another object is to provide such an apparatus which can be operated to perform the method of the present invention, which facilitates the practice of the method hereof and which is adaptable to the performance of a wide variety of label manufacturing operations.

Another object is to provide a discrete element, such as a label, adapted for rapid and inexpensive manufacture, capable of being dispensed without the problems associated with conventional elements and adapted to construction in a wide variety of different configurations.

Another object is to provide a method which permits the production of discrete elements retained in a continuous sheet without a carrier sheet and from which the discrete elements can be dispensed precisely, dependably and at minimum cost.

Another object is to provide an apparatus which is operable to perform the method of the present invention, which facilitates the production of a single continuous sheet incorporating the discrete elements therewithin, and which is adaptable to a wide variety of label manufacturing operations.

Another object is to provide a method for the dispensing of discrete elements, such as labels, from a single continuous sheet and applying of the discrete elements so dispensed to target areas, such as products to be labeled precisely, dependably and at minimum cost.

Another object is to provide an apparatus operable to perform the method for dispensing discrete elements from a single, continuous sheet and which does so in such a manner as to die cut each element and apply it to its respective designated target area in a single motion and in such a manner as to avoid becoming fouled with adhesive or other matter or jamming the apparatus.

Another object is to provide a form of label construction wherein the labels are contained within a single, continuous, non-perforated sheet capable of being wound into a roll for transport and storage and from which the labels can be dispensed precisely, dependably and a lower cost than has heretofore been possible.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENTS

Apparatus for Manufacturing Discrete Elements

Figure 1:
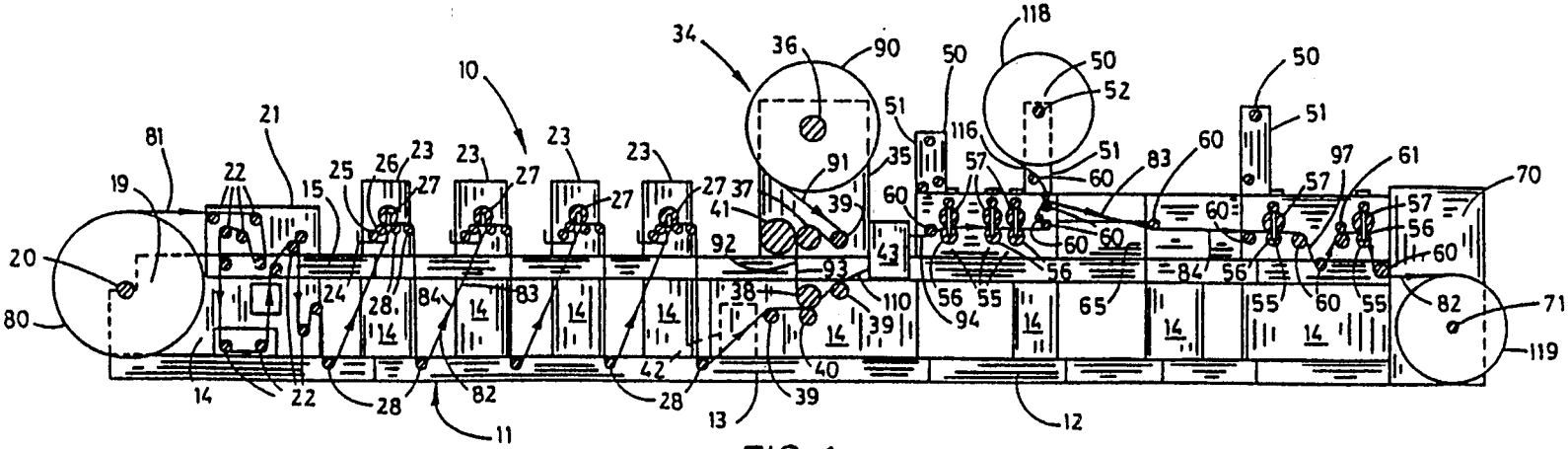
FIG. 1 a side elevation of the apparatus of the present invention employed in the practice of the method of the present invention.

Referring more particularly to the drawings, the preferred embodiment of the apparatus for manufacturing discrete elements of the present invention, operable to practice the method of the present invention, is generally indicated by the numeral 10 in FIG. 1. It will be understood that the embodiment shown and described herein is one of a great many embodiments of the apparatus which can be employed depending upon the specific type of elements, such as a label or other element, to be manufactured. This will become more clearly apparent upon reference to this description of the preferred embodiments. For illustrative convenience, the methods, apparatuses and discrete elements shown and described herein relate to the manufacture of labels, but it will be apparent that they can be employed to manufacture other types of discrete elements.

The apparatus 10 includes a narrow web printing press 11 having a main frame 12. The main frame has lower horizontal frame members 13 adapted to be mounted on a supporting surface, not shown. The main frame has vertical supports 14 on which are mounted upper horizontal frame members 25 substantially parallel to the lower horizontal frame members 13.

The printing press 11 has a roll mounting assembly or station 19 having a roll mounting reel 20 adapted to mount for rotational movement a roll of material hereinafter to be described from which such material can be dispensed. The printing press has a tension control assembly or station 21 mounting a plurality of tension station rollers 22. The printing press, as shown in FIG. 1, has four printing assemblies or stations 23 mounted on the printing press in side-by-side relation. It will be understood that any desired number of printing stations can be employed depending purely upon the requirements of the operator in manufacturing the particular elements or labels desired. Each of the printing stations has an ink source 24 in which is mounted an ink pick-up roller 25. An ink transfer roller 26 is mounted on each printing station in receiving relation to ink from the pick-up roller and disposed in feeding relation to a plate roller 27. Each of the printing stations has sheet or backup rollers 28. The pick-up roller 25 receives ink from the ink source 24, and the ink is then transferred through the transfer roller 26 to the plate roller 27 which actually contains the plate which applies the ink to the work product. Each printing station thus applies a different type or color of ink, a different form of print, or otherwise individually processes the work product passing therethrough to create the effect desired in the finished product. It will be understood that other types of printing assemblies or stations can alternatively be employed for printing including rotogravure, letterpress, silk screen and offset type assemblies.

The apparatus 10 of the present invention has an adhesive application assembly or station 34 not part of any conventional printing press. The adhesive application assembly or station includes vertical supports 35 affixed on the upper horizontal frame members 15 and adapted to mount the various components of the adhesive application station. A roll mounting reel 36 is borne by the vertical supports and is adapted rotationally to mount a roll of material hereinafter to be identified. An upper impression roller 37 is rotationally mounted on the vertical supports and a lower impression roller 38 is rotationally mounted on the vertical supports 14 of the printing press. The impression rollers are preferably adapted for the selective heating or cooling thereof. Similarly, sheet rollers 39 and a lower nip roller 40 are rotationally mounted on the vertical support 14 within the adhesive application station disposed in the relationship shown in FIG. 1 and diagrammatically in FIGS. 2 and 6.

Figures 2, 3, 4, 5:
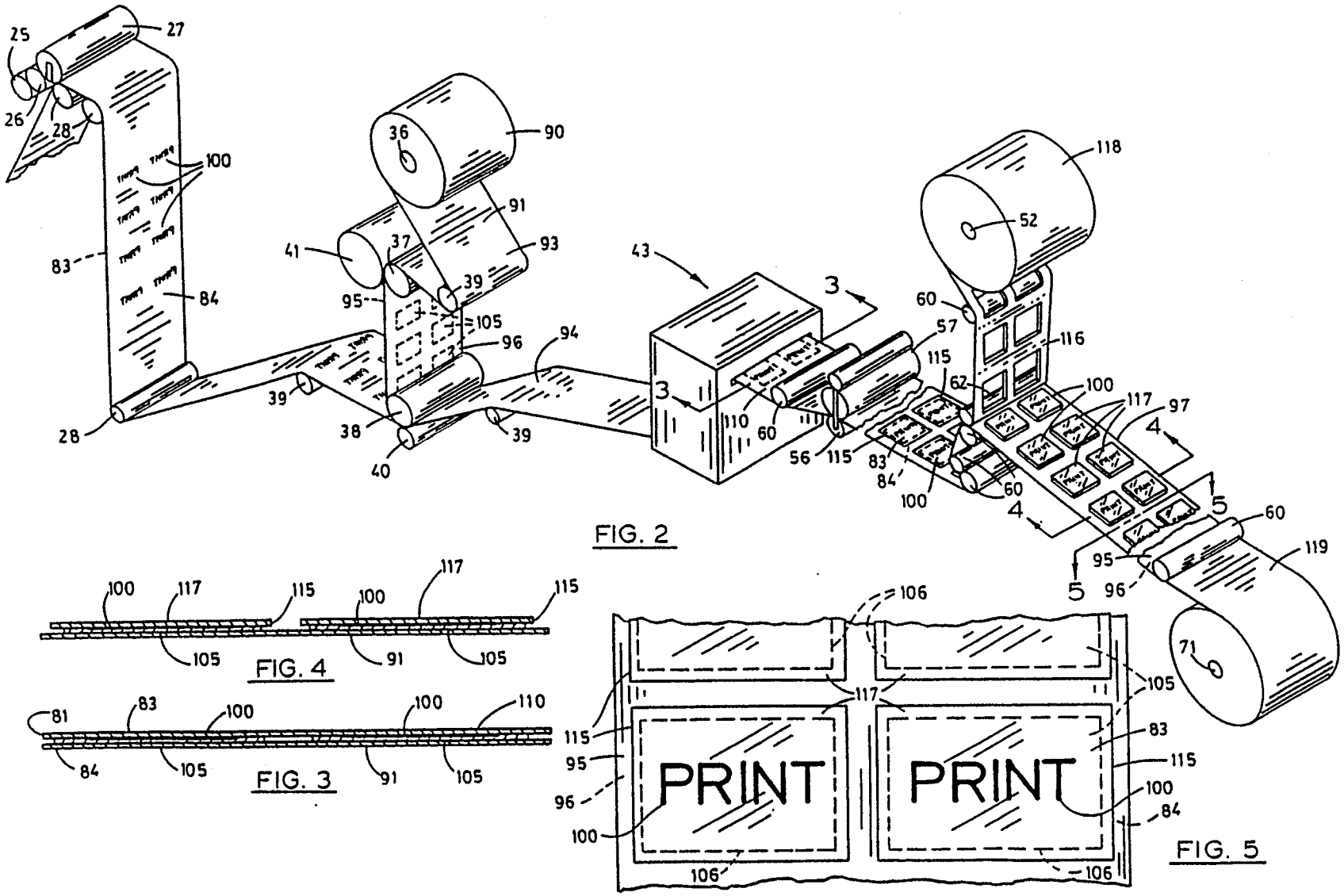
FIG. 2 is a somewhat enlarged, fragmentary diagrammatic perspective view illustrating a first embodiment of the method of the present invent ion in the manufacture of labels in which the print comprising the label is buried beneath a transparent film.
FIG. 3 is a somewhat further enlarged, transverse section taken on line 3—3 of FIG. 2.
FIG. 4 is a somewhat enlarged, transverse section taken on line 4—4 of FIG. 2.
FIG. 5 is a somewhat enlarged, fragmentary plan view taken from a position indicated by line 5—5 in FIG. 2.
Figures 6, 7, 8:
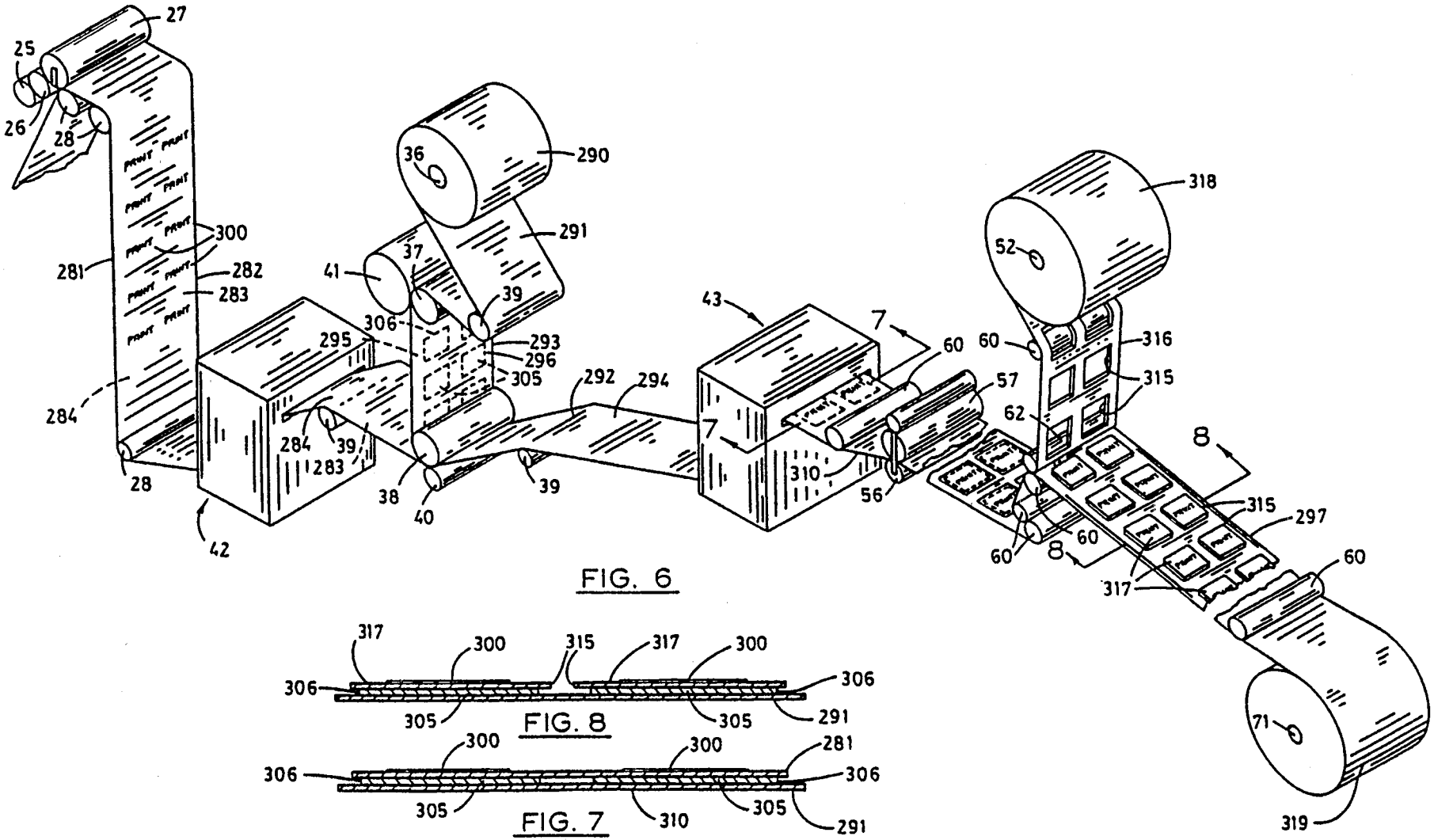
FIG. 6 is a somewhat enlarged, fragmentary, diagrammatic perspective view illustrating a second embodiment of the method of the present invention employed in the manufacture of labels in which the print comprising the written subject matter of the label is applied to the outer surface of the resulting label.
FIG. 7 is a somewhat further enlarged, transverse section taken on line 7—7 of FIG. 6.
FIG. 8 is a somewhat enlarged, transverse section taken on line 8—8 of FIG. 6.

An adhesive applicator or adhesive printing head 41 is rotationally mounted on the vertical supports 35 of the adhesive application station 34 in the positions shown in FIGS. 1, 2 and 6 and in substantially parallel juxtaposition to the upper impression roller 37. The printing head can be any one of several different types capable of applying discrete zones of adhesive in predetermined patterns in continuous operation. In the preferred embodiment the printing head is a rotary screen printing head which is operable to apply adhesive from a substantially cylindrical applicator through a screen pattern which defines the zone or zones. The screen is removable in the apparatus 10 of the present invention and a screen for defining virtually any zone or zones of adhesive can be installed. Thus, the shape, size, number and arrangement of zones can be selected by the operator. Similarly, the weight or thickness of adhesive and the specific type of adhesive can be selected by the operator. One rotary screen printing head capable of being modified for use in the apparatus of the present invention that originally manufactured by Matrix Industries, Inc. and sold under the trademark "Cora-Drum" and now sold by LTI Corporation, a subsidiary of GRACO INC., under the trademark "Microprint". Another such rotary screen printing head capable of such adaption is sold by Meltex Corporation. Among the other types of printing heads which can be adapted for such use and as a result are capable of operation to apply discrete zones of adhesive are the flexographic press, the rotogravure press, the print wheel press, the offset press and letterpress printing heads.

A first turnbar assembly 42 is shown in phantom lines in FIG. 1 mounted on the lower horizontal frame members 13 of the printing press 11. The apparatus 10 as shown in full lines in FIG. 1 is adapted to perform a specific label manufacturing process hereinafter to be described which does not require use of this first turnbar assembly. However, the first turnbar assembly is used in the process shown in FIG. 6 and hereinafter to be described. Accordingly, in FIG. 1 the first turnbar assembly is shown in phantom lines simply to indicate where that unit would be positioned for the process of FIG. 6. A second turnbar assembly 43 is mounted on the upper horizontal frame members 15 in the position shown in FIG. 1. The turnbar assemblies are conventional design and may be of any one of a number of different types. The turnbar assemblies operate to invert a sheet passing therethrough, or, in other words, a sheet passing through either of the turnbar assemblies is rotated about its longitudinal axis 180 degrees.

Three upstanding roll take-up assemblies or stations 50 are mounted on the printing press 11 and each station has a vertical support 51. A take-up reel 52 is mounted for rotational movement on the vertical supports 51 of each roll take-up assembly or station. The three roll take-up assemblies or stations are not normally all used at the same time, but rather are provided to permit the apparatus to be readily adapted to the manufacture of different types of labels or the like.

Five die cutting assemblies or stations 55 are mounted on the upper horizontal frame members 15 of the printing press 11. Each of the die cutting assemblies or stations has a lower impression roller 56 and an upper die cutting roller 57. It will be understood that the die cutting stations can be positioned on the printing press 11 and operated in the die cutting of labels as required for the particular type of label to be manufactured. In any case, die cutting is performed by the die cutting roller against the resistance of the impression roller of each die cutting assembly or station.

A plurality of sheet rollers 60 are mounted for rotational movement on the printing press 11 in positions to direct a continuous sheet passing therethrough along the desired course. A tension or nip roller assembly 61 is mounted on the printing press and operates to maintain the desired tension on a sheet passing therethrough. A waste matrix stripping bar 62 is mounted on the printing press in substantially parallel juxtaposition to the upper sheet roller 60 beneath the central roll take-up assembly or station 50.

A control module 65 containing the controls for operation of the apparatus 10 is mounted on the upper horizontal frame members 15.

A take-up or rewind assembly or station 70 is mounted on the printing press 11 on the end thereof opposite the unwind or roll mounting assembly or station 20. The rewind assembly or station 70 mounts for rotational movement a take-up reel 71.

Method

First Embodiment of Method

Using the apparatus 10 of the present invention heretofore described, the method of the present invention can be employed to manufacture discrete elements such as labels of a multiplicity of different types. For this purpose, it will be understood that the apparatus 10 may need to be rearranged in various respects in order to accommodate manufacture of a particular type of label. With the apparatus 10 arranged in the configuration shown in FIG. 1 and heretofore described, the apparatus can be employed, using the method of the present invention, to produce labels of the type shown in FIG. 4 and 5. The method for producing labels of this type using the apparatus of FIG. 1 is illustrated diagrammatically in FIG. 2. For this purpose, a roll of transparent film 80 is mounted rotationally on the reel 20 of the roll mounting assembly or station 19. The transparent film of the roll constitutes a face or element sheet 81 which can be fed from the roll. The element sheet is extended through the apparatus 11, as shown in FIGS. 1 and 2, along a first path of travel 82 extending from the roll mounting assembly or station 20 to the roll take-up station 50. Thus, the element sheet is unwound from the roll 80 and is wound about the tension station rollers 22 of the tension control station 21, as shown in FIG. 1, about the sheet rollers 28 and beneath the plate roller 27 of each printing station 23; over the sheet rollers 39 and between the lower impression roller 38 and nip roller 40; through the second turnbar assembly 43 wherein the sheet is inverted; through the first three die cutting stations 55 and, with respect thereto, between the impression roller 56 and die cutting roller 57 thereof; about the sheet rollers 60 to the left of and beneath the roll take-up station 50; about the waste matrix stripping bar 62; and on to the take-up reel 52 of the take-up station 50. This path constitutes a first path of travel 82. As can best be visualized upon reference to FIG. 2, and as will hereinafter be described, prior to entering the second turnbar assembly 43, the surface of the element sheet 81 disposed in an upwardly facing direction is actually the surface thereof which is thereafter placed in direct contact with the adhesive. Consequently, the surface of the element sheet to the right of the second turnbar assembly 43 facing in an upward direction is the face of the sheet which forms the face or front of the resulting label. In this context, the element sheet has a front surface 83 and a back surface 84 which correspond respectively to the front and back surfaces of the resulting labels.

A roll of a release or carrier sheet 90 is mounted on the roll mounting reel 36 of the adhesive application assembly or station 34. The roll can be unwound to dispense a continuous carrier sheet 91 which typically has at least one surface coated with an adhesive resistant substance such as a silicone type coating. The carrier sheet is unwound from the roll 90 and extended through the apparatus 10 from the roll 90 along a second path of travel 92 to the take-up reel 71 of the take-up or rewind station 70, as shown in FIGS. 1 and 2. The carrier sheet, so installed, extends in a first course 93 of the second path of travel 92 about the sheet roller 39, over the upper impression roller 37 and between the upper impression roller 37 and the adhesive printing head 41 to the lower impression roller 38. The carrier sheet is extended in the second path of travel along a second course 94 substantially coinciding where disposed in facing engagement with the element sheet 81 in the first path of travel between the lower impression roller 38 and the nip roller 40, over the sheet roller 39, through the second turnbar assembly 43 wherein the element and carrier sheets are together inverted, beneath the sheet roller 60 through the first three die cutting stations 55, about sheet roller 60 over waste matrix stripping bar 62. As can best be visualized in FIG. 2, adhesive is applied to the surface of the carrier sheet which faces the adhesive printing head and it is this surface on which the resulting labels are formed. This surface of the carrier sheet thus constitutes a front surface 95 of the carrier sheet and the opposite surface thus constitutes a back surface 96 of the carrier sheet. The second path of travel has a third course 97 extending from the stripping bar 62 to the take-up or rewind station 70.

After installation of the element sheet 81 and carrier sheet 91 as described, the apparatus 10 is adjusted and charged with those materials required for its operation. This includes adjustment of the tension on the element sheet 81 and carrier sheet 91, insuring that the printing stations are charged with ink and adjusted for proper operation, confirming that the adhesive printing head 41 is charged with adhesive and properly adjusted, checking the adjustment of the die cutting stations 55, checking the operability of the take-up reels 52 and 71 and the like.

Thereafter, the apparatus 10 is operated using the control module 65 and the other controls, not shown, of the various stations. As a consequence, the back surface 84 of the element sheet 81 is passed through the printing stations 23 in succession until after passage from the last printing station 23 in sequence, all of the print which will comprise the printed text of each of the complete labels is applied to the back surface 84 of the element sheet in positions corresponding to the labels to be formed. For illustrative convenience, such print is identified by the numeral 100 in FIGS. 2, 3, 4, and 5 and is illustrated as being of the size relative to the element sheet shown in those views. Further, as can be visualized on the left in FIG. 2, the print is applied to the back surface in such a way as to be readable through the front surface 83 of the element sheet by virtue of the fact that the element sheet is transparent film. In FIGS. 3 and 4, the print 100 is visible as a heavy dark line.

Simultaneously, the apparatus 10 draws the carrier sheet 91 from the roll 90 along the second path of travel. As the carrier sheet passes along the first course 93 of the second path of travel, it passes into engagement with the adhesive printing head 41 which applies a predetermined zone or zones of adhesive on the front surface 95 of the carrier sheet for each label to be manufactured. Since the screen of the printing head can be selected to apply virtually any zone or zones of adhesive, the particular pattern most appropriate for the particular type of label to be manufactured can be preselected by the operator. In the embodiment shown in FIG. 2 the adhesive is applied in a zone of adhesive 105 of a rectangular configuration individual to each label to be manufactured. The zone of adhesive thus has a rectangular periphery 106 which can, perhaps, best be visualized in FIG. 5.

It will also be seen that application of the print 100 to the element sheet 81 and of the zone of adhesive 105 to the carrier sheet is so adjusted that upon passage of the carrier sheet and the element sheet between the lower impression roller 38 and nip roller 40, the element and carrier sheets are adhesively married such that the print and zone of adhesive for each label are disposed in facing engagement and oriented relative to each other as shown best in FIG. 5. Since, as previously noted, the front surface 95 of the carrier sheet 91 is coated with an adhesive resistant coating, such as silicone substance, placing of the carrier sheet and element sheet in facing relation effectively causes each zone of adhesive 105 to adhere to the back surface 84 of the element sheet effectively capturing the print of each individual label between the back surface 84 of the element sheet and the adhesive. Thus, as will subsequently be seen, when the individual manufactured labels are pulled from the carrier sheet, the zone of adhesive 105 for each label is released from the front surface 95 of the carrier sheet and is retained on the label so formed.

If desired, however, the apparatus 10 add the method can be modified so that the zone of adhesive for each label is applied directly to the back surface 84 of the element sheet 81 by the adhesive printing head 41 after the application of the print 100 to the back surface 84.

When the element and carrier sheets 81 and 91 respectively are adhesively married as described, they form a web 110 which is passed through the second turnbar assembly 43 causing the web to be inverted or, in other words, rotated about its longitudinal axis 180 degrees. This disposes the front surface 83 of the element sheet in upwardly facing relation so that the print 100 for each label can be examined by the operator looking downwardly thereon.

Thereafter, the web 110 is passed through the die cutting stations 55 which severs the element sheet 81, in the embodiment shown in FIGS. 1, 2, 3, 4 and 5 along a rectangular course 115 individual to each label, and outwardly spaced from the periphery 106 of the zone of adhesive 105 for each label. Thus, the periphery 106 of the zone of adhesive for each label to be manufactured is inwardly spaced or recessed from the outer periphery of the resulting labels, as can best be seen in FIG. 5. Therefore, there is a space of a width which can be preselected by the operator extending entirely about each zone of adhesive 105 and to the periphery 115 of each resulting label in which there is no adhesive. As a result of the absence of adhesive within this space, the die cutting assembly does not become jammed or fouled by contact with adhesive.

Upon completion of the die cutting operation by passage through the die cutting stations 55, the web 110 is passed about the sheet rollers 60 and beneath the waste matrix stripping bar and 62. The element sheet 81, as previously noted, passes along the remainder of the first path of travel from the stripping bar and is wound onto the take-up reel 52. The zones of adhesive 105 retain the resulting labels on the carrier sheet. Thus, the portion of the element sheet 81 outside of the courses of severing 115 are stripped from the carrier sheet 91 in the form of a waste matrix 116 leaving the resulting labels 117 adhesively attached to the carrier sheet, as shown on the right in FIG. 2. The waste matrix is wound onto the take-up reel 52 as the process is continued to form a waste matrix roll 118.

Conversely, the carrier sheet 91 bearing the labels 117 is passed among the third course 97 of the second path of travel and is wound onto the take-up reel 71 to form a completed label roll 119. The label rolls thereafter can be rewound for inspection, to remove any damaged labels and to form new individual label rolls of predetermined label count. Alternatively, the carrier sheet bearing the labels can be cut into sheets to form stacks of such sheets.

The label rolls 119 or the rewound label rolls, so manufactured, are then delivered to the purchaser who employs conventional equipment to dispense the labels 117 from the carrier sheet 91 of the roll for application to the particular product or container for which the labels were ordered.

The method of the present invention and the apparatus 10 therefor can be varied in a multiplicity of ways for the purpose of the manufacture of labels of a particular type and in accordance with the orders placed therefor. However, the labels 117 are particularly desirable in a number of important respects. The periphery 106 of the zone of adhesive 105 of each label is recessed from the outer periphery of the labels. This facilitates dispensing of the labels from the carrier sheet in that it leaves an edge free from adhesive attachment to a carrier sheet which facilitates removal of each label and precise positioning in registry with the product. Furthermore, recessing of the zone of adhesive from the periphery 115 of each label leaves room for what migration of the adhesive may occur between the time of application of the adhesive to the carrier sheet and the time the adhesive cures. Thus, any migration which occurs does not migrate beyond or even to the periphery 115 of the label and therefore will not jam or clog any portions of the apparatus 10, nor interfere with stripping of the waste matrix, nor adhere to other surfaces within the label roll nor jam or otherwise interfere with dispensing of the labels from the carrier sheet during the process of attachment of the labels to the end product. Still further, the labels 117 retain the print 100 thereof in a "buried" relationship beneath the transparent film 80 of the label and between the transparent film of the label and the zone of adhesive 105. Consequently, the zone of adhesive protects the print from the underside and the transparent film of the label itself protects the print from the outer side and to such a degree that any scuffing of products bearing the labels does not in any way damage the print.

Second Embodiment of Method

A second embodiment of the method of the present invention is illustrated in FIGS. 6, 7 and 8. This method varies from that heretofore described primarily only in that and to the extent that it results in the manufacture of a label wherein the print is applied to the outer surface thereof. The method is primarily adapted for the production of labels wherein the label material itself is not transparent.

For practice of this method using the apparatus 10, the first turnbar assembly 42 is installed on the lower horizontal frame members 13 at the position shown in phantom lines in FIG. 1. The second turnbar assembly 43 is retained in the position shown in full lines in FIG. 1.

Thereafter, a roll 280, not shown in the drawings but corresponding to roll 80 in FIG. 1, of an element sheet 281 for use in manufacturing the labels to be formed with the second embodiment of the method of the present invention is installed on the roll mounting reel 20 and threaded through the first path of travel 282. The first path of travel 282 is identical to the first path of travel 82 described in respect to the first embodiment Of the method of the present invention with the except ion that the element sheet is extended through the first turnbar assembly 42 and the second turn bar assembly 43. Upon being threaded along the first path of travel 282, the free end of the element sheet is attached to the take-up reel 52 of the take-up station 50. For purposes of illustrative convenience, it will be understood that the element sheet has a front surface 283 and a back surface 284 with reference to its orientation with respect to the resulting labels. It will be seen that this relationship of the front and back surfaces of the element sheet 281 for the portion of the first path of travel on the far left in FIG. 6 is exactly the opposite of the relationship for the corresponding surfaces of the element sheet 81 shown on the far left in FIG. 2.

A roll 290 of a release or carrier sheet 291 is installed for rotational movement on the roll mounting reel 36 of the apparatus 10 and threaded along the second path of travel 292 including a first course 293 precisely corresponding to the first course 93 of the first embodiment of the method hereof and along second and third courses 294 and 297 respectively exactly corresponding to the second and third courses 94 and 97 of the first embodiment. The free end of the carrier sheet 290 is threaded along the second path of travel and attached at its remote end to the take-up reel 71 of the rewind station 70 of the apparatus. As can best be seen upon examination of the first course 293, the carrier sheet has a front surface 295 and a back surface 296 precisely corresponding to the surfaces 95 and 96 of the carrier sheet 91 of the first embodiment of the method of the present invention.

Thereafter, the apparatus 10 is operated using the control module 65 and the various other controls, not shown, so that the printing stations 23 apply print 300 on the front surface 283 of the element sheet 281 in areas corresponding to the labels to be formed. Since the print is applied to the front surface of what will be the same in the resulting labels, the print is readable from the surface directly visible on the far left in FIG. 6 as contrasted with the surface directly visible on the far left in FIG. 2.

As previously described with respect to the embodiment of the method shown in FIG. 2, the adhesive printing head 41 applies a zone of adhesive 305 to the front surface 295 of the carrier sheet 291 in positions corresponding to those of the labels to be formed. Each of the zones of adhesive has a rectangular periphery 306.

The element sheet 281, passing through the first turnbar assembly 242 is inverted so that upon reaching the lower impression roller 38 and nip roller 40, the element sheet is inverted. Accordingly, on passage of the element sheet and carrier sheet between the lower impression roller 38 and nip roller 40, the zones of adhesive 305 of the labels to be formed are placed in facing engagement with the back surface 284 of the element sheet and in alignment with the print 300 of their respective labels to be formed. Thus, the element sheet 281 and carrier sheet 291 are placed in adhesive engagement to form a web 310 extending from the lower impression roller 38 and nip roller 40 to the waste matrix stripping bar 62. The web is passed through the die cutting stations 55 which sever the element sheet 281 along courses of severing 315. As with the embodiment of the method of the present invention shown in FIG. 2, when the web passes about the waste matrix stripping bar 62, the waste matrix 316 is pulled from the carrier sheet leaving the labels 317 thereon, as shown in FIG. 6. The waste matrix is wound onto the take-up reel 52 to form a waste matrix roll 318. Simultaneously, the carrier sheet 291, bearing the labels 317 is wound onto the take-up reel 71 forming a label roll 319.

The labels 317 so formed consist of a nontransparent sheet bearing the print 300 and having a zone of adhesive 305 on the opposite side thereof recessed from the periphery 315 of each label and borne by the carrier sheet 291, as can best be seen in FIG. 8.

As previously noted, the method of the present invention can be employed to manufacture labels of a virtually infinite number of types. For example, the embodiment of the method shown diagrammatically in FIG. 2 can be employed in such a manner as to cause the print 100 to be applied to the front surface 83 of the element sheet rather than the back surface 84, as heretofore described. Similarly, the process can be varied that printing is performed after formation of the web so that, as viewed in FIG. 1, one or more of the printing stations 23 would be to the right of the lower impression roller 38 and nip roller 40. Further, the process can be varied in such a manner as to provide more than one lamination of sheets in various combinations including such variations wherein the end user of the product can remove an outer lamination from the label for use as a coupon. Still further, the die cutting stations 55 can be employed in a process so as to perforate a portion of the label permitting the end user to tear off a portion of the label for use as a coupon or the like. All of these variations are made possible by the process of the present invention for the first time permitting a label manufacturer to produce virtually any type of label in accordance with his customer's order without dependence upon ordering or himself manufacturing and curing prelaminated stock.

Third Embodiment of Method

Figures 13, 14, 15:
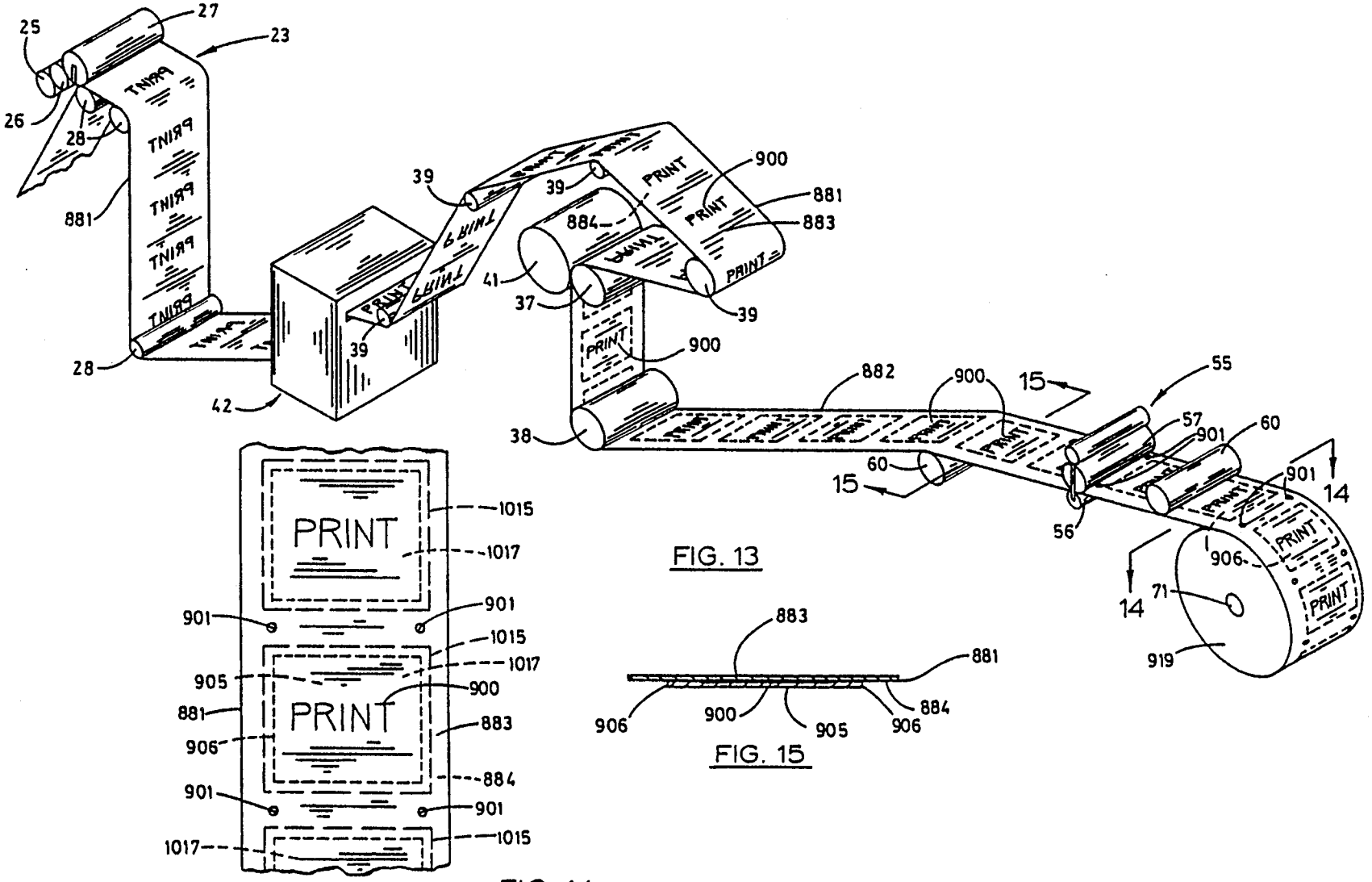
FIG. 13 a diagrammatic perspective view illustrating a third embodiment of the method of the present invention employed in the manufacture of labels contained within a single continuous sheet.
FIG. 14 is a somewhat enlarged, fragmentary plan view taken on line 14—14 in FIG. 13.
FIG. 15 is a somewhat further enlarged transverse vertical section taken on line 15—15 in FIG. 13.

A third embodiment of the method of the present invention is illustrated in FIGS. 13, 14 and 15. This method varies from those heretofore described in that it results in the manufacture of a label formed from a single sheet of material. Similarly, the labels are embodied in a single, continuous sheet of material which is wound into a roll for storage and from which the labels are subsequently dispensed, as will hereinafter be described. For purposes of comparison with the first and second embodiments, it will be seen that the single continuous sheet has no carrier sheet 91 or 291 as do those of the first and second embodiments.

Since there is no carrier sheet, in the practice of the third embodiment of the method the apparatus 10 does not use those portions thereof which are required in the other embodiments of the method for handling the carrier sheet. For illustrative convenience, only those portions of the apparatus 10 required for the practice of the third embodiment are shown in FIG. 13, it being understood that the apparatus 10 is otherwise as heretofore described.

Apparatus 10 is configured so that printing takes in one continuous pass through the apparatus and immediately prior to the application of adhesive roughly in the manner of the first and second embodiments of the method. Since, as previously noted, the apparatus 19 can be configured in a wide variety of different arrangements, the operator can choose the configuration most suited to the type of labels being manufactured and the raw materials from which the labels are to be manufactured.

In this described embodiment and purely for illustrative convenience, it will be understood that the method calls for the use of a roll of transparent film 880, not shown, which is mounted rotationally on the reel 29 of the roll mounting station 19 of the apparatus 10. The first turnbar assembly 42 is installed on the lower horizontal frame members 13 at roughly the position shown in phantom lines in FIG. 1. The second turnbar assembly 43 is, however, removed from the apparatus. One of the die cutting stations 55 is so configured as to form predetermined pacing holes, as will hereinafter be described, in the element sheet passed therethrough.

The roll of transparent film 889 consists of an element sheet 881, wound up to form the roll 889, for use in manufacturing the labels to be formed with the third embodiment of the method of the present invention. The element sheet is extended through the apparatus 11, as shown diagrammatically FIG. 13, along a first path of travel 882 extending from the roll mounting reel 29 to the take-up reel 71 of the take up or rewind station 70. Thus, the element sheet 881 is unwound from the roll 880 and is wound about the tension station rollers 20 of the tension control station 21, about the sheet rollers 28, and beneath the plate roller 27 of each printing station 23 through the first turnbar assembly 42; about the sheet rollers 39 as shown in FIG. 13 over the upper impression roller 37 and between the upper impression roller 37 and the adhesive printing head 41. The element sheet is wound about the lower impression roller 38, over the sheet roller 60 on the left as viewed in FIG. 13, through the die cutting station 55 configured to form pacing holes and with respect to the die cutting station between the impression roller 56 and the die cutting roller 57 thereof; and beneath the sheet roller 60 on the right as viewed in FIG. 13 and secured at its otherwise free end to the take-up reel 71.

The element sheet, as shown in FIG. 13, has s front surface 883 and a back surface 884. The front surface 883 has a high release finish or surface to which the adhesive applied by the adhesive printing head 41 will not adhere. The back surface 884, conversely, has a finish to which the adhesive adheres permanently.

As can be seen by reference to FIG. 13, the third embodiment of the method of the present invention is adapted to produce a single sheet construction incorporating a multiplicity of labels which in the manufactured form as entirely unitary. The sheet is used at a different time and place by a product manufacturer using the dispensing apparatus of the present invention hereinafter to be disclosed individually to sever the labels from the sheet and apply them to the products intended to receive them. For purposes of illustrative convenience, it will be understood that the element sheet once constructed using the third embodiment of the method is a transparent film in which the print is applied on the back surface 884 of the element sheet so as to be readable through the transparent film thereof from the front surface. The print is visible in FIG. 15 as a heavy dark line. The element sheet, once manufactured, also has pacing perforations or holes 901 extending therethrough in pairs between adjoining labels in the element sheet as can best be seem in FIG. 14. The holes are for use in the apparatus for applying the discrete elements to be described. While pacing holes are used for the purpose here, machine readable marks or bars can also be used where the dispensing apparatus is equipped to detect them.

After installation of the element sheet 881 as described, the apparatus 10 is adjusted and charged with those materials required for its operation as already described with respect to the first and second embodiments of the method.

Subsequently, the apparatus 10 is operated using the control module 65 and the other controls, not shown, of the various stations. Operation of the apparatus draws the element sheet through the apparatus along the first path of travel 882 and it is taken up on the take-up reel 71. As the element sheet passes through the printing stations the print 990 is applied on the back surface 884 thereof. Upon passing through the first turnbar assembly 42, the element sheet is inverted. The element sheet passes over the sheet rollers 39 and between the upper impression roller 37 and the adhesive printing head 41. The adhesive printing head 41 applies a predetermined zone or zones of adhesive on the back surface 884 of the element sheet for each label to be manufactured. As previously discussed, since the screen of the printing head can be selected to apply virtually any zone or zones of adhesive, the particular pattern most appropriate for the particular type of label to be manufactured can be preselected by the operator. In the embodiment shown in FIG. 13 the adhesive is applied in a zone of adhesive 905 of a rectangular configuration individual to each label to be manufactured. The zone of adhesive thus has a rectangular periphery 906 which can, perhaps, best be visualized in FIG. 14. In the preferred embodiment, the periphery 996 of the zone of adhesive 995 is recessed a short distance from what will be the periphery of the resulting label, as can be visualized in FIG. 15.

The element sheet passes through the die cutting station 55 adapted to form the pacing holes. The die cutting station cuts the element sheet to form a pair of pacing holes in each of the areas between adjoining zones of adhesive, as can best be seen in FIG. 14.

The third embodiment of the method of the present invention calls for the element sheet to be wound onto the take-up reel 71 after the adhesive is so applied for each label to be formed and the pacing holes established. The element sheet wound onto the take-up reel to form a completed label roll 919. No die cutting or other severing of the element sheet, with exception of forming the pacing holes, is performed. The label rolls so formed can thereafter be inspected for damage or rewound to form new individual label rolls of predetermined label count. Alternatively, the element sheet can be cut into sheets to form stacks of such sheets. The decision as to how the label roll is reconfigured, if at all, is based largely on the desires of the customer who will be applying the labels to his products.

In any case, the resulting label roll 919 consists of the element sheet 881 having a multiplicity of label areas formed therein each consisting of print 900 applied to the back surface 884 and readable through the front surface 883, a zone of adhesive 905 applied to the back surface 884 in covering relation to the print and spaced longitudinally of the adjoining label areas along the element sheet to form adhesive free areas longitudinally of the element sheet and between adjoining zones of adhesive with a pair of pacing holes 901 in each adhesive free area. In the preferred embodiment, although not necessarily, the periphery 906 of the zone of adhesive 905 is recessed from the entire periphery to be formed when the label is die cut, as will hereinafter be described.

As noted with respect to the other embodiments, the method and apparatus of the present invention can be varied in a multiplicity of ways for the purpose of the manufacture of labels of a particular type and in accordance with the orders placed therefor. Reference is made to the description herein with respect to the other embodiments in these respects.

Apparatus for Applying the Discrete Elements

Figures 16, 17:
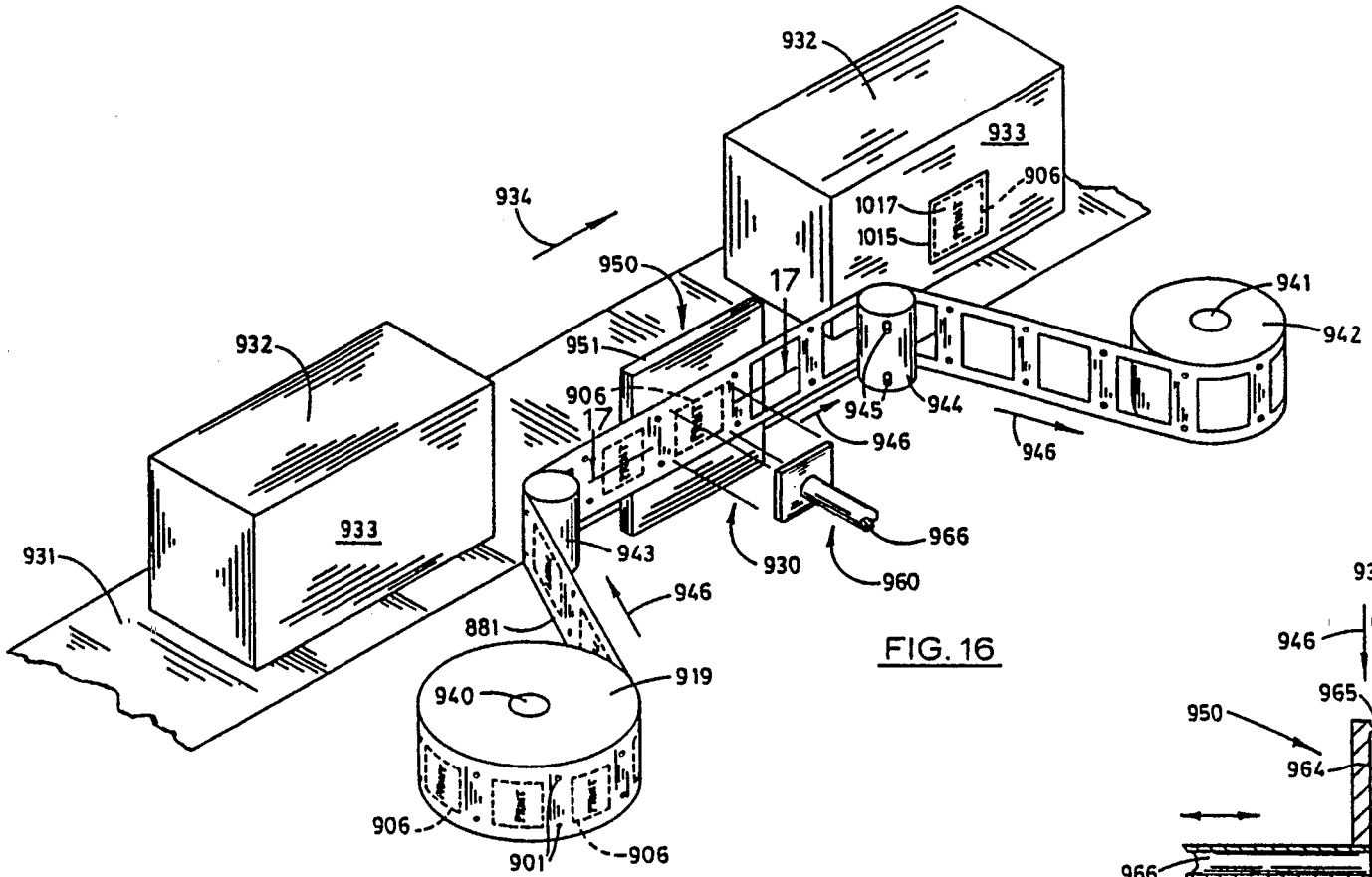
FIG. 16 is a diagrammatic perspective view of an apparatus of the present invention for dispensing labels from a single continuous sheet of labels and applying the labels individually on target areas, in this case being products.
FIG. 17 is a somewhat enlarged horizontal section taken on line 17—17 in FIG. 16 and fragmentarily showing a representative product in position to have a label applied thereto.

An apparatus for applying discrete elements contained in the element sheet 881 manufactured in accordance with the third embodiment of the method of the present invention is generally indicated by the numeral 930 in FIG. 16 where it is shown diagrammatically. Also shown, for illustrative convenience, in FIG. 16, a conveyor apparatus or line 931 transports representative products 932 therealong for the application of labels thereto. Each of the products has a target surface 933 to which a label is to be applied. The products are transported along the conveyor line in the direction of travel indicated by arrow 934 in advances of stepped progression.

It will be understood that most frequently the label roll 919 is manufactured in the practice of the third embodiment of the method as heretofore described by a label manufacturing company and then sold to a company manufacturing the products 932 in its plant. Accordingly, the apparatus 930 is installed and operated in the plant of the manufacturer of the products 932. Consequently, the operations hereinafter described take place weeks, months or even years after the manufacture of the label rolls 919, as heretofore described.

The apparatus 930 has a roll mounting reel 940 adapted to receive and mount for rotational movement one of the label rolls 919. A take-up reel 941 is mounted on the apparatus 930 in spaced relation to the roll mounting reel 940 and both reels are offset, as shown in FIG. 16, from the conveyor line 931. The take-up reel is adapted to receive the otherwise free end of the element sheet 881 of the label roll 919 and to wind it up in a waste remnant roll 942 hereinafter to be described. An idler roller 943 is mounted for rotational movement about an axis parallel to the axis of rotation of the roll mounting reel 940 and in a predetermined position immediately adjacent to the conveyor line 931. A power roller 944 is mounted for powered rotational movement about an axis of rotation parallel to that of the idler roller 943 and in spaced relation thereto, but immediately adjacent to the conveyor line 931. A power roller 944 is mounted for powered rotational movement about an axis of rotation parallel to that of the idler roller 943 and in spaced relation thereto, but immediately adjacent to the conveyor line 931. The power roller mounts drive pins 945 which, during operation of the apparatus 930, individually pass through the pacing holes 901 of the element sheet 881 and thereby engage the element sheet in driving relation in such a manner as to propel the element sheet in the direction of travel indicated by arrows 946 in FIG. 16. For reasons hereinafter to be noted, the movement of the element sheet by the power roller is in advances of stepped progression coinciding with movement of the products 932 by the conveyor line.

The idler roller 943 and the power roller 944 bound a die cutting and label applying station 950 in the apparatus 930. The die cutting and label applying station is in immediate juxtaposition to the conveyor line, as shown in FIGS. 16 and 17. The conveyor line and apparatus 930 are so positioned relative to each other that each of the products 932 is stopped in the station 950 in precise desired alignment with the apparatus 930 and at the precise desired time in its advances of stepped progression. Alternatively, the conveyor line and apparatus can be sequenced, without stopping for the application of the discrete elements, as will hereinafter be described.

The apparatus 930 includes a strike plate or anvil 951 mounted in immediate juxtaposition to the conveyor line in the station 950. The anvil has a strike surface 952 and an opposite back surface 953. A rectangular window or opening 954 extends through the anvil and is bounded by a periphery 955.

A die assembly 960 is borne by the apparatus 930 for reciprocal movement to and from the anvil 951. The die assembly has an arm 961 mounting a die plate 962 at an end thereof nearest the anvil. The die plate has a peripheral edge 963 larger than the periphery 955 of the opening 954, but in alignment therewith. The die plate has a strike surface 964 facing the anvil and which bears a severing blade or die strike 965 forming a rectangle just inwardly of the peripheral edge of the die plate. The die plate, die strike and anvil are so positioned relative to each other that in its advanced position the die strike contacts the strike surface 952 of the anvil just outwardly of and about the opening 954.

A compressed gas or air passage 966 extends through the arm 961 and the die plate 962 and is connected at its opposite end to a suitable compressed gas or air system, not shown, operable to deliver a short burst of compressed air other gas through the die plate 962 and the opening 954 of the anvil 951. A variety of suitable systems such as "air tamp" and "blow on" type systems are commercially available which operate to discharge a burst of gas against a label during application to a product to insure adhesive contact is made between the label and the product. Incorporation of an appropriate system of this type in the apparatus 930 would be suitable for the purpose, as will hereinafter be described in greater detail.

Similarly, it will be understood that the other operative subsystems of the apparatus 930 which drive the power roller 944, take-up reel, die assembly, air system and sequence their respective operations relative to the operation of the conveyor line 931 and the movement of products therealong can be of a variety of types.

Method for Applying the Discrete Elements

The method for applying the discrete elements incorporated in the label roll 919 is best understood by reference to FIGS. 16 and 17. The label roll 919 is mounted for rotational movement on the roll mounting reel 940. The otherwise free end of the element sheet 881 is pulled from the label roll and along the path indicated by arrows 946 about the idler roller 943, between the anvil 951 and the die assembly 960, about the power roller 944 with the drive pins individually engaged in the pacing holes 901 and secured on the take-up reel 941.

The apparatus 930 is then operated in conjunction with the conveyor line 931 to move the element sheet 881 in the direction indicated by arrows 946 in advances of stepped progression. Sequencing is such that, as shown in FIG. 17, when each product 932 reaches the precise desired position in the die cutting and label applying station 950, movement of the product is for an instant stopped. At this point, movement of the product is stopped with the precise portion of the target surface 933 of the product at which the label is to be applied in precise alignment with and in juxtaposition to the opening 954 of the anvil 951. At the same instant, the print 900 and zone of adhesive 905 from which a single label is to be formed is stopped for an instant between the die assembly 960 and anvil 951 and in precise alignment with the opening 954 of the anvil. The die assembly then moves into engagement with the anvil by the die strike 965 penetrating and severing the element sheet against the strike surface 952 of the anvil and thus forming a periphery 1015 for a discrete element of label 1017. As can be visualized FIG. 17, the periphery 906 of the zone of adhesive 905 recessed from the periphery 1915 of the label 1017. The die assembly is after die cutting immediately withdrawn to the position shown in FIG. 17.

Instantaneously, the air system, not shown, operates to deliver a burst of compressed air or gas through the air passage 966 and against the newly formed label driving it through the opening 954 of the anvil and into adhesive contact with the target surface thus affixing the label to the product in the precise position desired. This process is continuous so that the labels are individually die cut and applied to the products as both the products and the element sheet are moved in advances of stepped progression, a pause in such movement taking place alternatively with each advance. The element sheet subsequent to such die cutting is wound onto the take-up reel 941 to form the waste remnant roll 942.

It will be apparent with the method and apparatus for applying discrete elements and with the third embodiment of the method of the present invention which manufactures the label roll 919, that single sheet or linerless labels 1917 of a great variety of shapes, sizes, materials and shapes of zones of adhesive can be produced. By varying the type of material of the element sheet 881; the surface thereof to which print 900 is applied; the number, size and shape of the zones of adhesive for each label; and the size and shape of the die strike 965, almost any type of label can be produced.

In any case, with all of the labels 1017, of whatever specific size, shape, material and zone or zones of adhesive, the label roll 919 is produced at greatly reduced cost over those prior art types having a carrier sheet bearing labels. Furthermore, since the element sheet 881 is unitary, it is more durable and dependably handled than prior art constructions. The labels 1017 can be applied to the products by the manufacturers of such products at lower cost and with a precision not heretofore achieved in the art.

Discrete Elements

Illustrative of some of the different types of discrete elements such as labels and the like, in addition to those already shown and described, which can be manufactured using the method and apparatus of the present invention are the labels shown in FIGS. 9, 19, 11, 12, and 14. It will be understood that these are representative of only some of the types of labels, in particular those having different shapes and sizes and with different shapes and sizes of zones of adhesive, but in which the zones are recessed from the peripheries of the labels. If desired, however, the adhesive can be applied in zones with peripheries precisely corresponding to the peripheries of the labels. The labels 1917 shown in phantom lines in FIG. 14 are those manufactured using the third embodiment of the method of the present invention.

Figure 9:
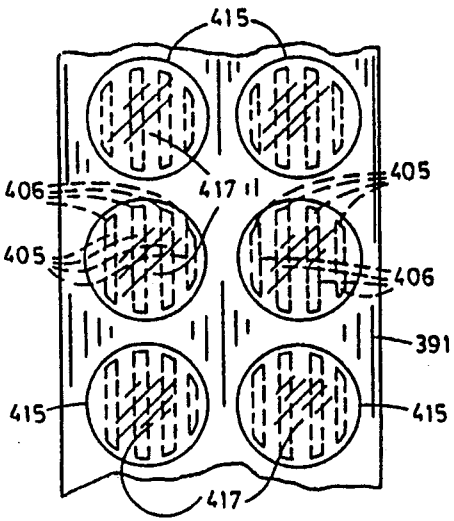
FIG. 9 is a somewhat enlarged, fragmentary top plan view of a carrier sheet bearing labels illustrating a first alternate pattern of adhesive application shown in hidden lines.

With respect to FIG. 9, a carrier sheet 391 is shown fragmentarily wherein zones of adhesive 405 have been applied to the carrier sheet. The zones of adhesive 495 for each of the labels to be manufactured are long narrow strips having peripheries 406 covering an area recessed from the peripheries 415 of the resulting labels 417.

Figure 10:
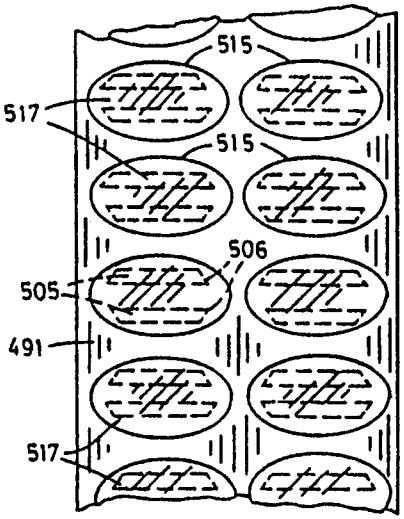
FIG. 10 is a somewhat enlarged, fragmentary top plan view of a carrier sheet bearing labels wherein the adhesive is applied in a second alternate pattern of adhesive application is shown in hidden lines.

In FIG. 10, a carrier sheet shown fragmentarily at 491 has zones of adhesive 505 applied thereto for each of the labels to be formed. Two zones of adhesive are applied to the carrier sheet for each label and the zones have peripheries 506 which are of narrow configuration and which extend transversely of the carrier sheet and are confined to an area smaller than the peripheries 515 of the labels 517 and recessed therefrom. As can be seen, the peripheries 515 of the labels are of oval configurations.

Figure 11:
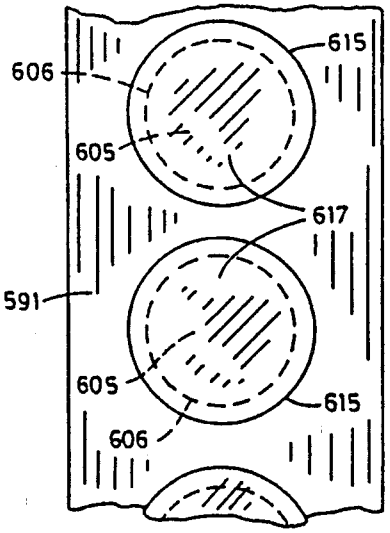
FIG. 11 is a somewhat enlarged, fragmentary top plan view of a carrier sheet bearing labels wherein the adhesive is applied in a third alternate pattern of adhesive application is shown in hidden lines.

A carrier sheet 591 shown fragmentarily in FIG. 11 has zones of adhesive 605 applied thereto. The peripheries 606 of the zones of adhesive are circular and one is provided for each label to be formed. The peripheries 606 are recessed from their respective peripheries 615 of the resulting labels 617.

Figure 12:
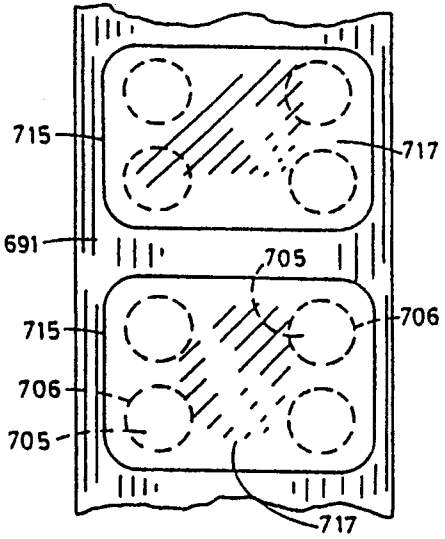
FIG. 12 a somewhat enlarged, fragmentary top plan view showing a carrier sheet bearing labels wherein a fourth alternate pattern of adhesive application is shown in hidden lines.

In FIG. 12, a carrier sheet 691 is shown fragmentarily to which are applied zones of adhesive 705. Four zones of adhesive 705 are applied to the carrier sheet for each label to be formed. The zones of adhesive have peripheries 706 of circular configurations and the zones are spaced from each other but taken together cover an area smaller than the peripheries 716 of the labels 717 formed thereby so that the zones of adhesive are in all cases shown recessed from the peripheries of the labels.

The labels 1017 shown in phantom lines in FIG. 14 are, as previously discussed, embodied unitarily in the element sheet 881 until they are die cut at the time of application to the product by the apparatus 930. Each label 1017, when die cut, in the form shown herein consists of a single transparent sheet having the print 990 applied to the back surface 884 and readable through the front surface 883 with the zone of adhesive 905 overlaying the print 990 on the back surface. The periphery 906 of the zone of adhesive 905 is recessed from the periphery 1015 of the label 1017. As with the other labels, however, label 1017 is only one of a wide variety of specific forms of the type of label which can be manufactured using the third embodiment of the method of the present invention.

Therefore, the method and apparatus for manufacturing discrete elements, the discrete elements and method and apparatus for applying the discrete elements of the present invention permit the operator to manufacture at one place of operation and at one time virtually all types of labels and the like rapidly, inexpensively and without requiring the maintaining of an inventory of prelaminated stock and without the multitude of problems associated with conventional methods and apparatus, thereby substantially reducing the overall expense of the operation while vastly improving the number and quantity of types of labels and the like which can be manufactured.

Although the invention has been herein shown and described in what are conceived to be the most practical and preferred embodiments, it is recognized that departures may be made therefrom within the scope of the invention, which is not be limited to the illustrative details disclosed.

Having described our invention, what we claim as new and desire to secure by Letters Patent is:

1. A label assembly comprising:

a carrier sheet having a longitudinal direction;

a plurality of discrete labels arranged longitudinally on said carrier sheet, each of said labels having a surface facing said carrier sheet each said surface including an adhesive free margin terminating in an edge oriented transversely to the longitudinal direction of the carrier sheet; and adhesive between and directly engaging both said carrier sheet and each said surface except at said adhesive-free margin to adhesively but releasably secure said labels to said carrier sheet, said adhesive being arranged in longitudinally separate zones with adhesive free areas therebetween, each of said adhesive free areas being aligned with a corresponding adhesive free label surface margin to facilitate subsequent removal of said labels from said carrier sheet.

2. The assembly of claim 1 wherein each of said labels is substantially transparent and further comprising printing on said surface, said printing being observable through said label.

3. The assembly of claim 2 wherein said printing is disposed between said label and said adhesive.

4. A label assembly comprising:

a carrier sheet having a longitudinal direction and a transverse direction;

adhesive engaging said carrier sheet in zones spaced longitudinally along said carrier sheet leaving adhesive-free areas therebetween; and a plurality of labels arranged longitudinally along said carrier sheet, each of said labels having a surface facing said carrier sheet and directly engaging said adhesive, each of said surfaces including an adhesive free transverse margin portion overlying one of said adhesive-free areas to facilitate subsequent removal of said labels from said carrier sheet as said carrier sheet is moved in its longitudinal direction.

* * * * *

UNITED STATES PATENT AND TRADEMARK OFFICE

CERTIFICATE OF CORRECTION

PATENT NO. : 5,351,426

DATED : October 4, 1994

INVENTOR(S) : Peter A. Voy et al

It is certified that error appears in the above-indentified patent and that said Letters Patent is hereby corrected as shown below:

Column 20, Claim 1, Line 22:
after the first instance of "a" insert —continuous—

Column 20, Claim 1, Line 25:
after "sheet" insert —,

Column 20, Claim 1, Line 26:
after "adhesive" delete —free margin terminating in an edge oriented transversely to the longitudinal direction of the carrier sheet— and insert "portion and an adhesive-free perimeter margin extending entirely around said adhesive portion"

Column 20, Claim 1, Line 30:
after "and" insert —said adhesive portion of"

Column 20, Claim 1, Line 30:
after "surface" delete —except at said adhesive-free margin— and insert "and not engaging said adhesive-free perimeter margins"

Column 20, Claim 1, Line 33:

after "in" delete —longitudinally—

Col. 20, Claim 1, Line 36:
after "adhesive free" delete --Label surface-- and insert --perimeter--.

Col. 20, Claim 4, Line 46:
after the first instance of "a" insert --continuous--.

UNITED STATES PATENT AND TRADEMARK OFFICE

CERTIFICATE OF CORRECTION

PATENT NO. : 5,351,426

DATED : October 4, 1994

INVENTOR(S) : Peter A. Voy et al

It is certified that error appears in the above-indentified patent and that said Letters Patent is hereby corrected as shown below:

Column 20, Claim 4, Line 46:
after "direction" delete --and a transverse direction--

Column 20, Claim 4, Line 48:
after "spaced" delete --longitudinally--

Column 20, Claim 4, Line 53:
after "sheet" delete --and-- and insert ", each of said surfaces including an adhesive portion"

Column 20, Claim 4, Line 54:
after "surfaces" insert --further--

Column 20, Claim 4, Line 54:
after "including" delete --an adhesive free transverse margin portion overlying one of said adhesive-free areas-- and insert "an adhesive-free perimeter margin extending entirely around said adhesive portion and not engaging said adhesive"

Signed and Sealed this

Twenty-first Day of March, 1995

*Attest:*

Bruce Lehman

BRUCE LEHMAN

*Attesting Officer*

*Commissioner of Patents and Trademarks*